US007690069B2

(12) United States Patent
Chen et al.

(10) Patent No.: US 7,690,069 B2
(45) Date of Patent: Apr. 6, 2010

(54) CLEANING TOOL WITH ATTACHMENT PROJECTIONS PROVIDING ADDITIONAL CLEANING FUNCTIONALITIES

(75) Inventors: Fung-Jou Chen, Appleton, WI (US); Jeffrey D. Lindsay, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1147 days.

(21) Appl. No.: 11/304,005

(22) Filed: Dec. 14, 2005

(65) Prior Publication Data

US 2007/0130710 A1 Jun. 14, 2007

(51) Int. Cl.
*A47L 13/12* (2006.01)

(52) U.S. Cl. ..... 15/115; 15/114; 15/228

(58) Field of Classification Search ..... 15/115, 15/114, 228, 167.1
See application file for complete search history.

(56) References Cited

U.S. PATENT DOCUMENTS

| | | | | |
|---|---|---|---|---|
| 2,922,425 | A * | 1/1960 | Lerner et al. | 132/212 |
| 3,005,219 | A | 10/1961 | Miller | |
| 3,299,462 | A | 1/1967 | Mathison | |
| 4,071,983 | A | 2/1978 | Thielen | |
| 4,455,705 | A | 6/1984 | Graham | |
| 5,002,075 | A * | 3/1991 | Kellett et al. | 132/108 |
| 5,419,015 | A | 5/1995 | Garcia | |
| 6,021,542 | A * | 2/2000 | Norman | 15/169 |
| 6,508,602 | B1 * | 1/2003 | Gruenbacher et al. | 401/7 |
| 6,726,386 | B1 | 4/2004 | Gruenbacher et al. | |

FOREIGN PATENT DOCUMENTS

| | | |
|---|---|---|
| DE | 88054276 | 8/1988 |
| GB | 779187 | 7/1957 |
| GB | 2 031 039 | 4/1980 |
| WO | WO 98/42246 | 10/1998 |
| WO | WO 00/27271 | 5/2000 |
| WO | WO 02/41746 A2 | 5/2002 |
| WO | WO 03/000104 A1 | 1/2003 |
| WO | WO 03/000105 A1 | 1/2003 |

* cited by examiner

*Primary Examiner*—Shay L Karls
(74) *Attorney, Agent, or Firm*—Dority & Manning, P.A.

(57) ABSTRACT

A cleaning tool, such as a mop, used for cleaning a surface includes a cleaning head having a face with a plurality of projections extending therefrom. A cleaning pad is removably attached to the cleaning head face by engagement with the projections, the pad being formed of a first material having a thickness and composition such that the projections penetrate through the pad and extend beyond an outer planar surface of the first material. The projections thus serve to securely attach the cleaning pad to the head and also provide an abrasive scrubbing functionality to the cleaning tool.

26 Claims, 4 Drawing Sheets

CLEANING TOOL WITH ATTACHMENT PROJECTIONS PROVIDING ADDITIONAL CLEANING FUNCTIONALITIES

BACKGROUND

Cleaning tools, such as mops, are commonly used in order to clean surfaces and other objects found in industry and residential settings. Mops typically include an elongated handle with a mop head attached to the handle. A disposable wipe or pad component may be attached to the mop head, the wipe configured to pick up dirt, lint, fluid, and other material from a surface when the mop head is moved over the surface. The disposable wipe may be designed to pick up these materials in a dry or wet state. Once the disposable wipe reaches the end of its design life, the user may remove the wipe from the mop head and subsequently dispose of the wipe. At such time, a new disposable wipe may be applied to the mop head in order to resume or start cleaning.

Various configurations have been used in the art to removably attach the disposable wipes to the mop head or other cleaning implement. For example, one conventional method utilizes attaching means provided on the top side of the mop head, such as slits, clips, or other mechanical means formed into the mop head. The wipes have lateral edges that are pulled by the user so as to extend over onto the top side of the mop head to be tucked into retaining slits or otherwise engaged by clips or other devices on the top side of the mop head.

It is also known in the art to utilize hook fasteners disposed on the bottom or "application" side of the mop head, the hook fasteners engaging directly with the wipe material, or with hook compatible material provided on the cleaning wipe, to secure the wipe relative to the mop head. Reference is made, for example, to U.S. Pat. No. 5,419,015 that describes a mop head with a work pad removably attached thereto by hook fasteners located in recessed areas of the application side of the mop head.

The bottom surface of a conventional mop head is generally flat and the disposable wipe is pressed flat against the surface to be cleaned, which typically is also a substantially uniform flat surface. While smaller particles may be adequately removed and retained by the mop head, cleaning in this manner is often ineffective at capturing and retaining larger particles, such as accumulations of dust or lint, from the surface to be cleaned. For instance, balls of dust and/or lint may be shed from the disposable wipe either during cleaning, or after the mop head has been lifted up from the surface that was being cleaned. In this regard, it has also been proposed in the art to configure disposable wipes or pads intended for use with mops with multiple cleaning functionalities, including an "abrasive" or scrubbing feature. For example, the cleaning surface of the wipe may include raised areas or "tufts" of increased density to provide the wipe with an abrasive characteristic, as well as a desired degree of absorbency. Reference is made, for example, to U.S. Pat. No. 6,797,357 that describes a disposable cleaning wipe that may be used with a mop head, wherein the wipe has a macroscopic three-dimensional surface topography created by peaks formed in the wipe material. It is alleged that this structure provides the wipe with the enhanced ability to pick up and retain particulate dirt particles.

The UK patent GB 2031039 discloses a disposable wipe for a dust mop made from a nonwoven fabric having areas of varying degrees of embossing. These areas possess different degrees of structural integrity and a desired cleaning characteristic for the working face of the wipe.

U.S. Pat. No. 4,741,941 discloses a nonwoven web useful as a cleaning wiper having projections separated by land areas. The projections render the wipes particularly useful for scrubbing applications.

Conventional disposable wipes for use with mop heads may also be a composite or laminate of different materials that provide the wipe with different functionalities. For example, an abrasive material may form a layer of a multilayer product that also includes an absorbent layer.

The conventional methods for increasing the versatility of disposable wipes intended for use with a cleaning implement, such as a mop, involve significant and relatively expensive modifications to the wipe material. The present invention seeks to provide an improved cleaning device utilizing a disposable cleaning wipe with multiple cleaning functionalities while avoiding relatively complicated and often cost prohibitive modifications to the wipe material.

SUMMARY

Various features and advantages of the invention will be set forth in part in the following description, or may be obvious from the description, or may be learned through practice of the invention.

The present invention provides for a cleaning tool, which in certain exemplary embodiments may be a mop, for use in cleaning any variety of surfaces. The cleaning tool provides a unique and efficient means for attaching a disposable pad or wipe to a cleaning head of the cleaning tool while also providing the toll with multiple cleaning functionalities, including an abrasive or scrubbing functionality. The cleaning tool is thus useful for cleaning surfaces requiring more that a wiping action from a soft wipe to remove all undesired matter. For example, the cleaning tool may provide a generally aggressive scrubbing or abrasive functionality for removing larger adhered matter, as well as a wiping functionality for removing finer surface particulates, dust, and so forth. The multiple functionalities are provided by the combination of the cleaning head and pad, and are not dependent on complex or diverse structure of the cleaning pad alone.

In a particular embodiment, the cleaning tool includes a cleaning head having an application face with a plurality of projections extending therefrom. With a mop embodiment, this cleaning head corresponds to the mop head attached to a handle by any conventional means, preferably a pivotal arrangement. In alternate embodiments, the cleaning head may be a stand-alone component that is held in a user's hand, or attached to a hand-held cleaning implement. The cleaning head may be a component that is attached to a powered cleaning machine, such as a buffer, scrubber, and so forth.

A pad is removably attached to the application face of the cleaning head by engagement with the projections. This pad is formed of a first material having a composition and thickness such that the projections penetrate through the pad material and extend beyond an outer planar surface of the first material. In this manner, the projections provide an abrasive scrubbing functionality, and the pad material provides a different cleaning functionality to the cleaning tool. In certain embodiments, the pad may be made of a material selected to provide a less abrasive, or more abrasive, functionality as compared to the projections, or an absorbent functionality, or a relatively non-abrasive wiping functionality.

In one embodiment, the pad may comprise apertures adapted to receive the projections. Such apertures may be formed by the penetration of heated pins, by stamping, by laser ablation, or any other known method. In another embodiment, the projections penetrate through the porous pad, displacing material to the sides as the projections pass through the pad. In such embodiments, the pad may be substantially free of apertures or other openings other than the pores that are inherent to the porous material of the pad itself.

The projections may be defined in various patterns on the application face of the cleaning head. For example, the projections may be defined in a uniform pattern over generally the entire surface area of the application face. In an alternate embodiment, the projections may be defined in discrete regions on the application face, for example along the edges of the application face, or in a discrete middle region. The projections may have the same or different configuration within the different discrete regions depending on the desired cleaning functionalities of the different regions. For example, the projections may have a first configuration and spacing along the edges of the application face to provide a more intense scrubbing functionality as compared to a middle region of the application face.

The projections may vary in their shape and configuration, but generally include a base portion and a head portion. The head portion is designed to penetrate through the cleaning pad material and provide a desired degree of cleaning abrasiveness, while allowing for relatively easy removal of the pad from the cleaning head by a user pulling the pad away from the cleaning head. At the same time, the projections provide sufficient resistance to in-plane sheer forces generated in use of the cleaning tool to prevent the pad from sliding or moving relative to the cleaning head, for example as a mop is moved in a back and forth motion across a floor surface. In a particular embodiment, the projections have a head portion width dimension that is not greater than that of the base, and extend generally linearly from the base portion to the head portion. For example, the projections may have a cylindrical or conical configuration with a blunt or pointed head portion. In one embodiment, the projections rise from the cleaning head at an acute angle, such that the axis of any given projection is between, for example, about 5 degrees and 45 degrees from vertical relative to a horizontal surface of the cleaning head. In another embodiment, the projections comprise a curved portion that may, for example, form a hook. In one related embodiment, a plurality of projections have hooked portions at their distal ends that are oriented in a single direction such that the performance of the projections during cleaning will depend on the direction of wiping. When the cleaning head is moved approximately in the direction defined by the orientation of the hooks defined by the projections, the hooks may engage fibers or other debris, whereas when the cleaning head is moved in the opposite direction, materials engaged by the hooks may be released or the hooks may not be as likely to engage and retain fibers or other matter. It is recognized that if projections are curved or at an angle other than 90 degrees, the size of apertures in the cleaning pad may need to be increased to facilitate easy attachment of the pad to the cleaning head.

For ease of manufacture, the projections may be formed integral with the cleaning head by, for example, being molded directly into the cleaning head, or defined on the application face in a subsequent cutting, grinding, etching, laser or other forming operation.

The pad may be formed of any manner of suitable material, or combination of materials, that permits penetration of the projections with minimal force by the user. For example, the pad may be formed of an open cell foam, such as a melamine or urethane foam, a relatively stiff nonwoven material, such as a spunbond material. Besides serving to attach the pad to the cleaning head, these materials also possess characteristics to achieve a desired cleaning functionality, such as absorbency, abrasiveness, and so forth. In general, the pad material may be any suitable material having sufficient structural integrity to allow penetration of the projections with adequate frictional engagement to ensure that the pad does not slip relative to cleaning head with use of the cleaning tool. Various exemplary materials for use as the first pad material are described in detail below.

The cleaning pad may also include one or more additional layers of material adhered to the first material. For example, a second material may be attached over at least a portion of the first material, with this second material selected primarily to provide the cleaning tool with a desired cleaning functionality that may not be obtainable with the first material. This second material may be a nonwoven material, a foam, an abrasive filament web, and so forth. The projections may extend completely through and beyond an outer planar face of the second material. In an alternate embodiment, the projections extend into the second material, but not beyond the outer planar face of the material until the cleaning tool is used. The second material may be generally compressive so that the penetration of the projections beyond the outer face of the second material may be controlled by the user as a function of the degree of application force applied to the tool by the user. For example, to clean surfaces requiring an abrasive scrubbing action, the user may apply a greater compressive force to the tool to cause the projections to extend through the second material. For less aggressive cleaning, the user may apply less force such that the projection heads are recessed within the second material.

In a particularly unique embodiment, a cleaning agent, such as a disinfectant, bleach, or other cleaning compound, is contained within the pad and is released upon engagement of the pad by the projections. This agent may be in a liquid, powder, or granular form and stored within a recess defined in the pad. The agent may be stored directly within the recess with a film or other sealing material disposed over the recess. Upon sufficient application of force, the projections will extend through the recess and pierce the film, thereby releasing the cleaning agent. In an alternate embodiment, the agent may be contained in a pouch placed within in the recess. The pouch may be adhered directly within the recess, or held within the recess by an overlying second pad material, such as a nonwoven material. Upon sufficient application of force, the projections will pierce the pouch material and release the cleaning agent.

Aspects of the invention will be described in greater detail below by reference to particular non-limiting embodiments illustrated in the drawings.

DETAILED DESCRIPTION

Figure 1:
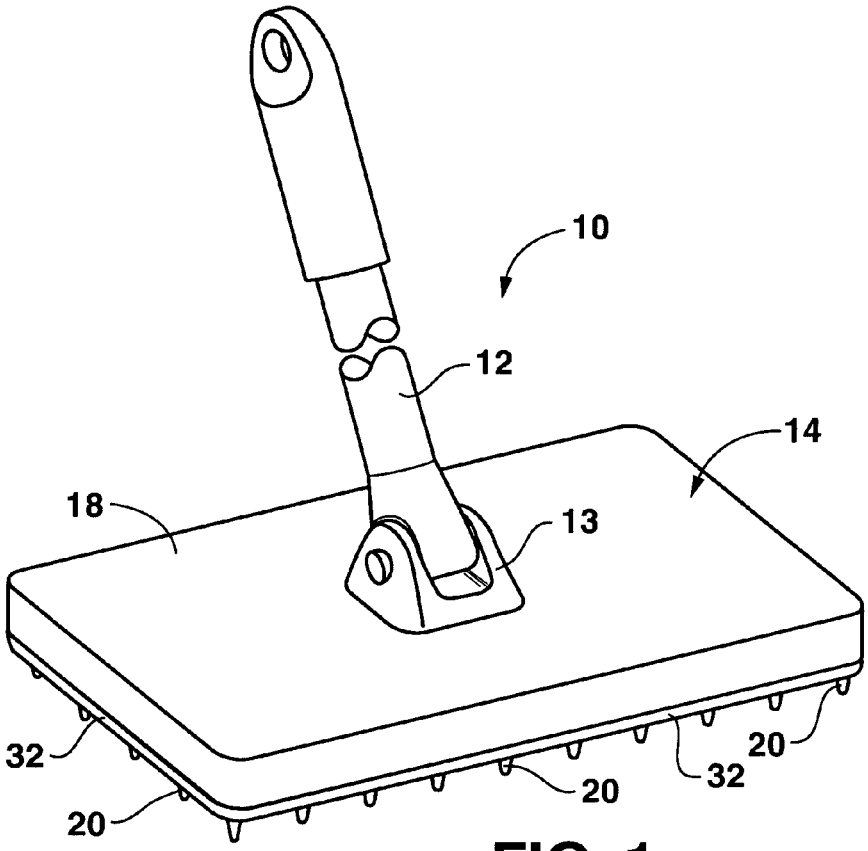
FIG. 1 is a perspective view of a clean tool configured as a mop incorporating aspects of the present invention.

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

The present invention provides for a cleaning tool 10 intended for cleaning any manner of desired surface. In the illustrated embodiments, the tool 10 is illustrated as a mop. Various constructions of mops are well known in the art and need not be described in detail herein for an appreciation or understanding of the present invention. It should also be appreciated that the cleaning tool 10 is not limited to a mop embodiment, and encompasses any manner of cleaning instrument that incorporates the novel aspects of the invention, such as a hand-held implement, machine mounted implement (e.g., a buffer pad), and so forth.

Referring to FIGS. 1 through 4 in particular, the cleaning tool 10 is embodied as a mop wherein the handle 12 is pivotally attached to a cleaning head 14 (mop head) by way of any manner of conventional pivotal mechanism 13. The cleaning head 14 includes a back surface 18 and an opposite application face 16, as particularly seen in FIG. 2. The cleaning head 14 may be made of any conventional rigid material, such as a molded plastic, and the like. A plurality of projections 20 extend generally transversely from the application face 16. The projections 20 may be defined in various patterns on the application face 16. For example, in the embodiment illustrated in FIGS. 1 through 4, the projections 20 extend in a uniform pattern generally over the entire surface area of the application face 16. The number and spacing of the projections 20 may vary widely within the scope of the invention so long as a minimum number and disposition of the projections 20 is provided to ensure that the pad component 32 (described in detail below) is securely attached to the application face 16. The number and location of the projections 20 will also determine the degree of abrasiveness or scrubbing functionality provided by the projections 20.

Figure 6:
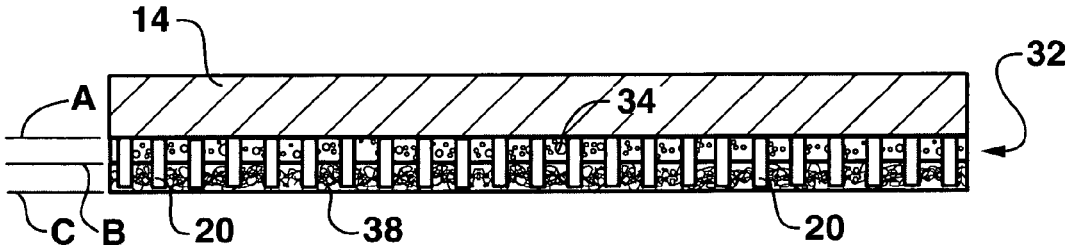
FIG. 6 is a cross-sectional view of still another embodiment of a cleaning head with attached pad.

The projections 20 may vary in their shape and configuration, but generally include a base portion 24 and a head portion 22. The head portion 22 is designed to penetrate through the cleaning pad 32 and provide a desired degree of cleaning abrasiveness. In this regard, the head portion 22 may have a generally pointed configuration, as illustrated in FIGS. 1 through 4, or a cylindrical face as illustrated in FIG. 6. The projections 20 are designed to provide sufficient resistance to in-plane sheer forces generated by the pad 32 in use of the cleaning tool 10, for example when the mop head 14 is moved back and forth across a surface. The projections 20 prevent the pad 32 from slipping or moving relative to the application surface 16 when subjected to such sheer forces. The projections 20 are also configured to allow the pad 32 to be removed from the mop head 14 by a user simply pulling the pad away from the application surface 16. In this regard, the projections 20 have a head width dimension that is generally not greater than the dimension of the base. For example, the projections 20 may have a conical configuration wherein the sides of the projections 20 taper from a relatively wide base portion 24 to a truncated head portion 22, as seen in FIGS. 1 through 4. In an alternative embodiment, the projections 20 may have a cylindrical configuration, as illustrated for example in FIG. 6. The sides 26 of the projections 20 may be linear from the base portion 24 to the head portion 22. For example, referring to FIG. 2, the sides 26 are linear and taper towards the head portion 22. In the embodiment of FIG. 6, the sides are linear and generally parallel to define the cylindrical configuration of the projections 20. The cylindrical projections 20 illustrated in FIG. 6 may further include a pointed or truncated head portion 22 at the distal end of the projections 20.

The projections 20 may be defined on the application face 16 by any conventional means. For ease of manufacture, the projections 20 may be formed integral with the cleaning head 14 by, for example, being molded directly into the cleaning head. In alternative embodiments, the projections 20 may be defined on the face in a subsequent operation, such as a grinding, cutting, or other suitable operation designed to form the projections 20. In still an alternative embodiment, the projections 20 may be separately attached or adhered to the application face 16.

Figure 2:
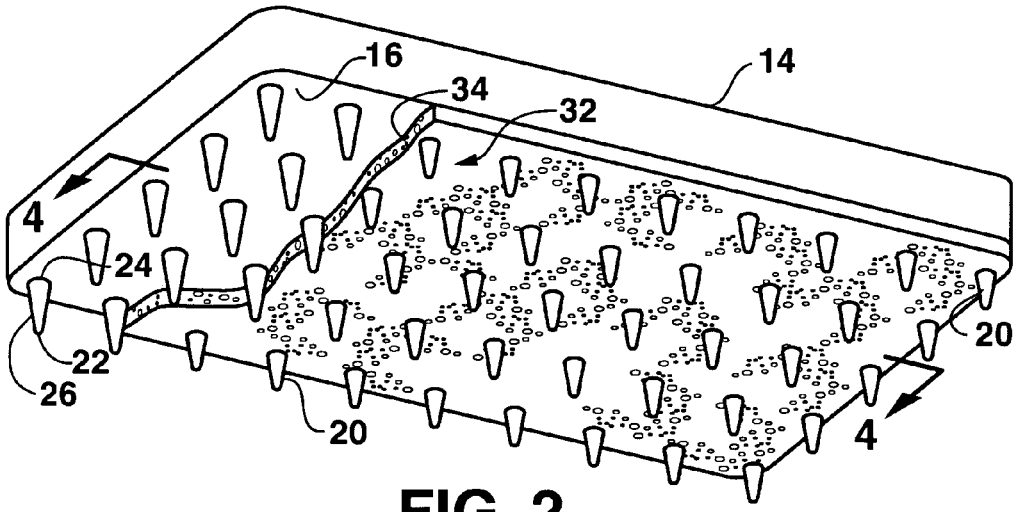
FIG. 2 is a bottom view of the cleaning head of the tool of FIG. 1 shown in partial cross-section.
Figure 3:
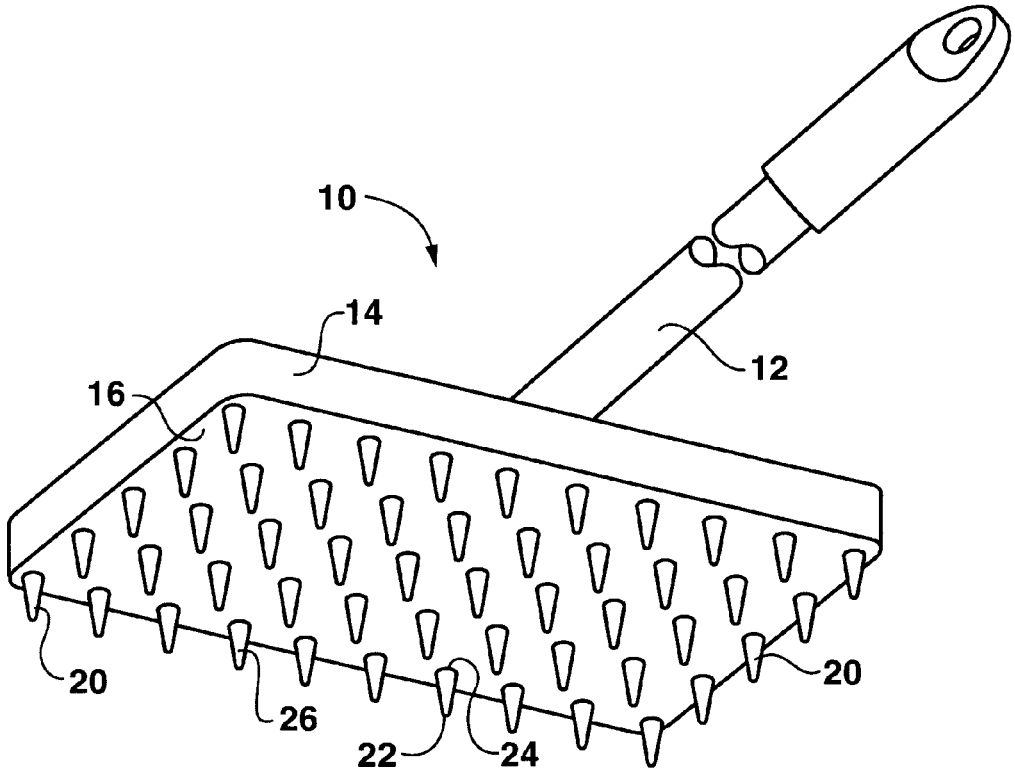
FIG. 3 is a perspective view of the application face of the cleaning head with the disposable pad removed and particularly illustrates an embodiment of projections in a uniform pattern over the surface area of the application face.
Figure 4:
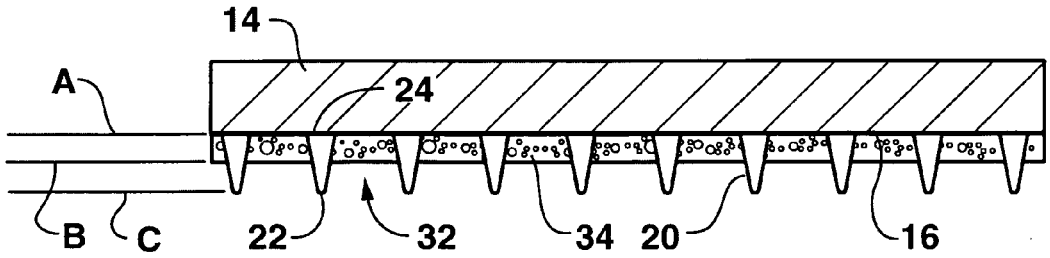
FIG. 4 is a cross-sectional view of a cleaning head with attached pad that particularly illustrates the height relationship of various components.

As mentioned, a pad 32 is removably attached to the application face 16 of the cleaning head 14 by engagement with the projections 20. This pad 32 is formed of a first material 34 having a thickness and composition such that the projections 20 penetrate through the pad material. For example, referring to FIG. 4, the application face 16 has a planar surface A and the projections 20 have a height C relative to the planar surface A. The pad 32 has an outer planar surface B that is intermediate of the planar surface A and height C of the projections 20. Referring to FIG. 2, when the pad 32 is mounted to the application surface 16, at least the head portions 22 of the projections 20 penetrate through the first material 34 and thus define a plurality of scrubbing elements over a desired surface area pattern with respect to the first material 34.

The first material 34 of the pad 32 provides a desired cleaning functionality that may be more or less abrasive than the projections 20. The first material 34 may also provide any desired degree of absorbency, or any other combination of functional characteristics. The first material 34 may be any manner of suitable material, or combination of materials, that provides the desired cleaning functionality, as well as the structural integrity that permits penetration of the projections 20 with minimum force while frictionally engaging with the projections to resist in-plane sheer forces with use of the cleaning tool 10. Any number of available materials may be used in this regard, including open cell foams, nonwoven webs, and so forth. These nonwoven or foam materials also possess various characteristics for providing any desired cleaning functionality, such as absorbency, abrasiveness, and so forth. Various exemplary materials for use as the first pad material 32 are described in greater detail below.

The projections 20 may be provided in discrete zones or regions on the application face 16. For example, in the embodiment of FIG. 5, the projections 20 are provided in discrete zones 30*b* and 30*c* along edges of the application face 16. A separate discrete zone 30*a* is provided in a middle region of the application face. The discrete regions 30*a*, 30*b*, and 30*c* of projections 20 may be separated by areas of the application face 16 that are void of projections 20. These discrete regions may be provided at any desired location on the application face 16 depending on the desired cleaning functionality. For example, the projections 20 may be provided at the forward or leading edge of the application face 16, particularly for a mop embodiment of the cleaning tool 10, so that the projections 20 provide an initial abrasive scrubbing action when the mop is pushed by the user in the forward direction. Another discrete region of the projections 20 may be provided at the trailing edge of the application face 16. Similarly, projections 20 may be provided along the lateral edges of the application face 16.

The projections 20 may vary in size, number, configuration, and spacing between different discrete regions. For example, still referring to FIG. 5, the projections 20 in the discrete regions 30*b* and 30*c* have a conical configuration and are spaced relatively far apart as compared to the cylindrical projections 20 in the middle discrete region 30*a* of the application face 16. The projections 20 may also have a different hardness or resiliency in the different discrete regions, depending on the desired cleaning functionality to be achieved from the projections 20 in the respective discrete regions. It should be appreciated that any combination of projections 20 in any pattern of discrete regions on the application face 16 is within the scope and spirit of the invention.

Figure 5:
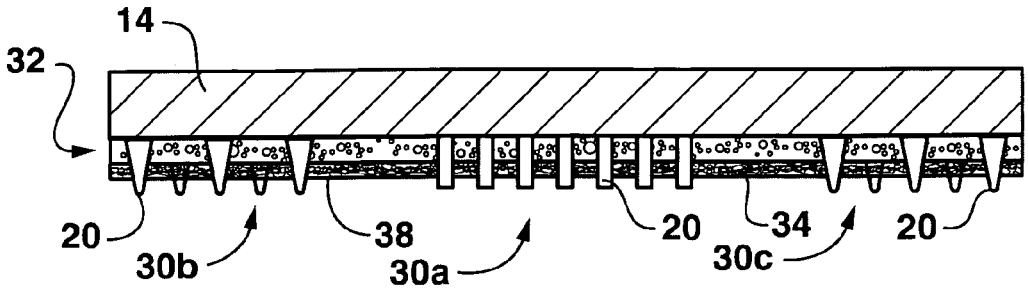
FIG. 5 is a cross-sectional view of an alternative embodiment of a cleaning head with attached pad.

The cleaning pad 32 may also incorporate one or more additional layers of material 38 adhered, laminated, or otherwise, attached over at least a portion of the first material 34. This second material 38 is selected to provide the cleaning tool 10 with a desired cleaning functionality that may not be possible with the first material 34 that is used primarily to attach the pad 32 to the projections 20. This second material 38 may be any suitable material, including a nonwoven material, foam, abrasive filament web, and so forth, depending on the particular desired cleaning functionality. Various materials suitable for the second material 38 are described in greater detail below. Referring to FIG. 5, the second material 38 is illustrated as a nonwoven web that extends entirely over the surface of the open cell first material 34. It should be appreciated that the second material 38 may be provided in discrete regions over the first material 34 depending on the desired location of the cleaning functionality of the second material 38. In this embodiment, the projections 20 extend completely through and beyond an outer planar surface of the second material 34.

In an alternate embodiment, illustrated for example in FIG. 6, the first material 34 of the pad 32 is defined by a planar surface B. The projections 20 extend completely through the first material 34 and beyond the planar surface B. The second material 38 has an outer planar surface C. The projections 20 extend into the second material 38, but do not extend beyond the planar surface C of the second material. However, the second material may be generally compressive, such as a meltspun nonwoven web, such that penetration of the projections beyond the outer face of the second material 38 may be controlled by the user of the cleaning tool 10 as a function of the degree of application force applied to the cleaning head 14 by the user. For example, to clean surfaces requiring an abrasive scrubbing action, the user may apply a greater compressive force to the cleaning head 14 to cause the material 38 to compress and the projections 20 to extend at least partially beyond the outer face of the second material 38. For less aggressive cleaning, the user may apply less force to the cleaning head 14 such that the head portions of the projections 20 remain recessed within the second material 38.

The cleaning pad 32 may provide various functionalities in addition to presenting a surfacing having a desired cleaning functionality. For example, the pad 32 may be configured to deliver any manner of agent to the surface to be cleaned. In a particular embodiment, the agent is a cleaning agent, such as a disinfectant, bleach, or other cleaning compound, that is contained within the pad and released upon engagement of the pad 32 by the projections 20. This may be accomplished in various ways. For example, referring to FIGS. 7 and 8, the agent may be a liquid, powder, or granular composition stored in a pouch 44. This pouch 44 is, in turn, contained with a recess 48 defined in the pad 32 over a number of projections 20. These recessed projections 20 may have a size (height) and configuration different than the projections 20 in the other areas of the application face 16, as particularly illustrated in FIG. 8. The pouch 44 may be contained within the recess 48 by any conventional means, including an adhesive, friction fit, and so forth. In the embodiment illustrated in FIGS. 7 and 8, an additional porous second material 38 is disposed over the first material 34 and also serves to maintain the pouch 44 within the recess 48, as particularly illustrated in FIG. 8. When sufficient compressive force is applied by the user to the cleaning head 14, the projections 20 disposed adjacent to the pouch 44 will rupture the pouch and release the cleaning agent 42. The agent 42 is then free to migrate out of the pouch 44 and through the second material 38 of the pad 32. This migration may be aided in wet environments wherein the pad 32 is exposed to liquid, for example, in a wet-mop application.

In an alternate embodiment, the cleaning agent 42 may be contained directly in the recess 48 without the use of a pouch or other structure. For example, referring to FIG. 9, the agent 42 is contained in the recess 48, which is sealed with a film material 46, or any other suitable sealing material. The projections 20 extend at least partially into the recess 48 and, upon a sufficient compressive force being applied to the cleaning head 14 by the user, the projections 20 will pierce the film 46 and allow the cleaning agent 42 to migrate out through the film 46, as illustrated in FIG. 9.

Figure 7:
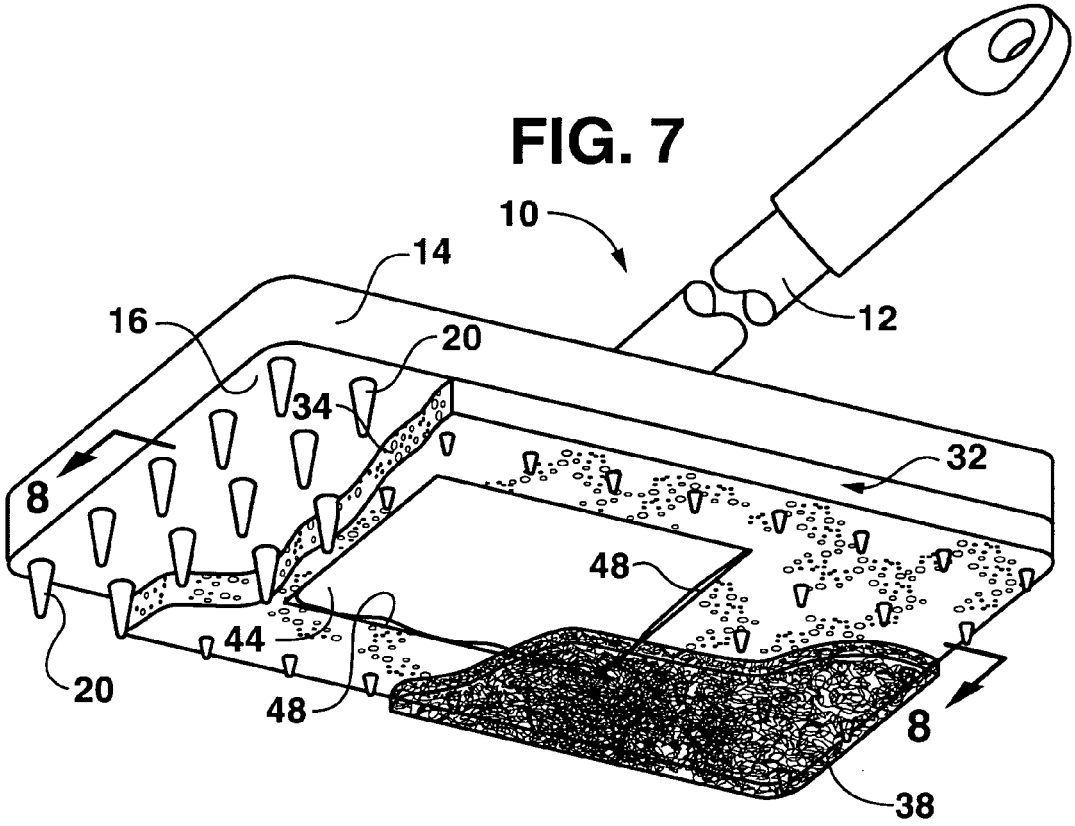
FIG. 7 is a bottom perspective view of an embodiment of a cleaning head with attached pad that incorporates an agent within a recess in the pad.
Figure 8:
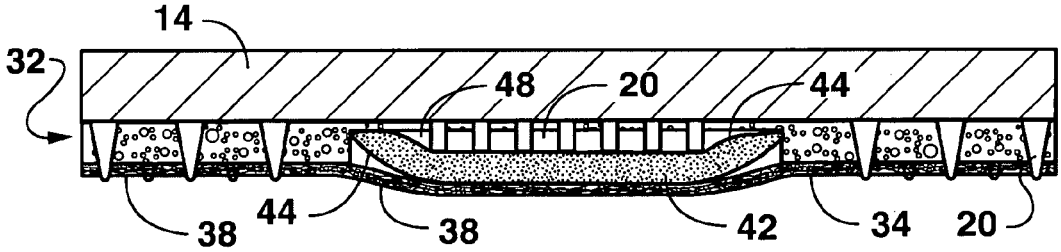
FIG. 8 is a cross-sectional view of the cleaning head taken along the lines indicated in FIG. 7.
Figure 9:
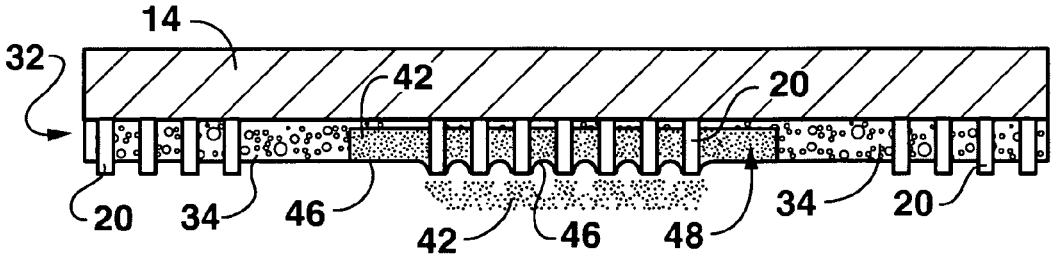
FIG. 9 is a cross-sectional view of an alternate embodiment of a pad incorporating a cleaning agent within a recess defined in the pad.

It should be appreciated that the embodiments illustrated in FIGS. 7 through 9 for releasing an agent contained within the cleaning pad 32 are non-limiting examples of any number of arrangements for releasing an agent from the pad 32 by engagement of the pad with projections 20. All such variations are within the scope and spirit of the invention. For example, the agent may be in a granular or powder form dispersed homogeneously throughout the pad material 34 such that at least a portion of the agent 42 is forced or pushed out of the pad 32 upon engagement of the pad with the projections 20. The agent may be contained in capsules that are broken to release the agent upon attachment of the pad 32 with the projections 20, or upon compression of the pad 32.

Various examples of agents 42 that may be delivered by the pad 32 include cleaning agents such as floor wax, scrubbing agents, disinfectants, deodorants, bleach, etc. The agent 42 may also act as a biosensor for indicating the presence of a biological agent, such as anthrax, or chemical agents. In one such bioluminescent system, the agent 42 includes B lymphocytes that contain antibodies for the target analytes and a green fluorescent protein from jellyfish that becomes activated when the antibodies contact the target analytes. Various types of biosensors are disclosed in U.S. patent application Ser. No. 10/277,170 filed on Oct. 21, 2002 and entitled "Healthcare Networks With Biosensors", which is assigned to the assignee of the present application. The entire contents of U.S. patent application Ser. No. 10/277,170 are incorporated by reference herein in their entirety for all purposes. The biosensor may be a fluorescent protein or a genetically engineered cell in a pathogen identification sensor that glows when the biosensor detects the presence of the particular bacterial or chemical agent. An example of a fluorescent protein may be found in U.S. Pat. No. 6,197,928 entitled "Fluorescent Protein Sensors for Detection of Analytes", which issued on Mar. 6, 2001. The entire contents of U.S. Pat. No. 6,197,928 are incorporated by reference herein in their entirety for all purposes.

The disposable wipe pad 32 may be electrostatically charged either uniformly, or in a pattern, in order to assist in the capture and retention of the generally smaller size particles thereon. Methods for providing electrostatic charge (e.g., electrets) in a nonwoven web are well known. Examples include U.S. Pat. No. 6,365,088, issued Apr. 2, 2003 to Knight et al., and in U.S. Pat. No. 5,401,446 issued Mar. 28, 1995 to Tsai et al, both of which are herein incorporated by reference.

As described above, the first material 34 of the disposable pad 32 may be an open cell foam material, such as an aminoplast foam (e.g., foams made from urea-formaldehyde resins or melamine-formaldehyde resins) or a phenolic foam such as a foam made from phenol-formaldehyde resins, wherein the foam has mechanical properties suitable for frictionally engaging with the projections 20 to adhere the pad 32 to the cleaning head 14, as well as for contacting and cleaning a surface. Melamine-based foam has been recognized in the art as an effective cleaning agent. A detailed description of foams made of aminoplasts, i.e., for example, formaldehyde condensation products based on urea, melamine, dicyanodiamide and/or derivatives thereof, are found, for example in *Kunststoff-Handbuch*, Vol. X, Vieweg-Becker "Duroplaste", Karl Hanser Verlag, Munich, 1968, pp. 135 et seq., especially 466-475, including the bibliography cited therein. Corresponding information on foams of phenoplasts is found, for example, in Ullmann, *Encyklopadie der technischen Chemie,* 3rd ed., Vol. 15 (1964), pp. 190-1 including the bibliography mentioned therein.

Principles for manufacturing melamine-based foam are well known. Melamine-based foams are currently manufactured by BASF (Ludwigshafen, Germany) under the BASOTECT brand name. For example, BASOTECT 2011, with a density of about 0.01 g/cm$^3$, may be used. Blocks of melamine-based foam for cleaning are marketed by Procter & Gamble (Cincinnati, Ohio) under the MR. CLEAN brand name, and under the CLEENPRO name by LEC, Inc. of Tokyo, Japan. Melamine-based foam is also marketed for acoustic and thermal insulation by many companies such as American Micro Industries (Chambersburg, Pa.).

Principles for production of melamine-based foam are disclosed by H. Mahnke et al. in EP-B 071 671, published Dec. 17, 1979. According to EP-B 017 671, they are produced by foaming an aqueous solution or dispersion of a melamine-formaldehyde condensation product which comprises an emulsifier (e.g., metal alkyl sulfonates and metal alkylaryl sulfonates such as sodium dodecylbenzene sulfonate), an acidic curing agent, and a blowing agent, such as a C5-C7 hydrocarbon, and curing the melamine-formaldehyde condensate at an elevated temperature.

U.S. Pat. No. 6,503,615, issued Jan. 7, 2003 to Horii et al., discloses a wiping cleaner made from an open-celled foam such as a melamine-based foam, the wiping cleaner having a density of 5 to 50 kg/m3 in accordance with JIS K 6401, a tensile strength of 0.6 to 1.6 kg/cm2 in accordance with JIS K 6301, an elongation at break of 8 to 20% in accordance with JIS K 6301 and a cell number of 80 to 300 cells/25 mm as measured in accordance with JIS K 6402. Melamine-based foams having such mechanical properties can be used within the scope of the present invention.

Brittle foams can be made, as described in German publication DE-AS 12 97 331, from phenolic components, urea-based components, or melamine-based components, in aqueous solution with a blowing agent and a hardening catalyst.

The entire disclosure of U.S. Pat. No. 6,608,118 is incorporated by reference herein in its entirety.

Melamine-based foams are also disclosed in British patent GB 1443024, issued Jul. 21, 1976.

Further, any aminoplast foam or other rigid or brittle foam disclosed in U.S. Pat. No. 4,125,664, "Shaped Articles of Foam Plastics," issued Nov. 14, 1978 to H. Giesemann, herein incorporated by reference, may be used to produce the products of the present invention. Other foams believed to be useful within the scope of the present invention include those disclosed in U.S. Pat. No. 4,666,948, "Preparation of Resilient Melamine Foams," issued May 19, 1987 to Woerner et al.; U.S. Pat. No. 5,234,969, "Cured Phenolic Foams," issued Aug. 10, 1993 to Clark et al.; U.S. Pat. No. 6,133,332, "Process for Producing Phenolic Resin Foams," issued Oct. 17, 2000 to T. Shibanuma; and WO 91/14731, "Stable Aminoplast Cellular Foams and Process for Manufacturing Them," published Oct. 3, 1991 by Mäder et al., all of which are herein incorporated by reference. The latter, WO 91/14731, discloses cellular foams obtained by using an unsaturated, halogenated polyalcohol in a resin precondensate constituent and a dodecylbenzolsulphonic acid partially esterified preferably with a fatty alcohol and a long-chain polyhydric alcohol such as a polyethylene glycol, in a foaming agent hardener constituent.

In one embodiment, the foam material may comprise a thermoset foam, and the thermoset components of the cleaning foam may comprise over 50%, over 60%, over 80%, or over 90% of the mass of the foam. Alternatively, the solid polymeric components of the cleaning foam may consist essentially of one or more thermoset materials. In another embodiment, the cleaning foam is substantially free of thermoplastic materials. In another embodiment, the cleaning foam does not comprise more than 50% of any one of a component selected from polyolefin materials, polyurethanes, silicones, and polyesters.

In other embodiments, the first material 34 may be a material formed into an open, porous structure that has sufficient strength to adhere the pad 32 to the protrusions 20 as desired, and hardness to form a rough, scratchy surface on the pad 32. Suitable materials are abundant and may be either natural or synthetic materials. Possible exemplary materials may include any known abrasive materials formed into the desired open structure. Possible synthetic materials may be polymeric materials, such as, for instance, meltspun nonwoven webs formed of molten or uncured polymer which may then harden to form the desired abrasive layer.

Other materials used as abrasives in known commercial scrubbing products could also be used, such as apertured nylon covers, nylon networks, and materials similar to those found in other abrasive products such as, for instance, SCOTCHBRITE pads of 3M Corp. (Minneapolis, Minn.).

In one embodiment, the first material 34 of the pad 32 may include a meltspun web, such as may be formed using a thermoplastic polymer material. Generally, any suitable thermoplastic polymer that may be used to form meltblown nonwoven webs may be used for the abrasive layer of the scrubbing pads. For instance, in one embodiment, the material may include meltblown nonwoven webs formed with a polyethylene or a polypropylene thermoplastic polymer. Polymer alloys may also be used in the abrasive layer, such as alloy fibers of polypropylene and other polymers such as PET. Compatibilizers may be needed for some polymer combinations to provide an effective blend. In one embodiment, the abrasive polymer is substantially free of halogenated compounds. In another embodiment, the abrasive polymer is not a polyolefin, but comprises a material that is more abrasive than say, polypropylene or polyethylene (e.g. having flexural modulus of about 1200 MPa and greater, or a Shore D hardness of 85 or greater).

Thermosetting polymers may also be used, as well as photocurable polymers and other curable polymers.

The first material layer 34 may be a web comprising fibers of any suitable cross-section. For example, the fibers of the abrasive layer may include coarse fibers with circular or non-circular cross-sections. Moreover, non-circular cross-sectional fibers may include grooved fibers or multi-lobal fibers such as, for example, "4DG" fibers (specialty PET deep grooved fibers, with an eight-legged cross-section shape). Additionally, the fibers may be single component fibers, formed of a single polymer or copolymer, or may be multi-component fibers.

In an effort to produce an abrasive layer having desirable combinations of physical properties, in one embodiment, nonwoven polymeric fabrics made from multi-component or bicomponent filaments and fibers may be used. Bicomponent or multi-component polymeric fibers or filaments include two or more polymeric components which remain distinct. The various components of multi-component filaments are arranged in substantially distinct zones across the cross-section of the filaments and extend continuously along the length of the filaments. For example, bicomponent filaments may have a side-by-side or core and sheath arrangement. Typically, one component exhibits different properties than the other so that the filaments exhibit properties of the two components. For example, one component may be polypropylene which is relatively strong and the other component may be polyethylene which is relatively soft. The end result is a strong yet soft nonwoven fabric.

In one embodiment, the material layer 34 comprises metallocene polypropylene or "single site" polyolefins for improved strength and abrasiveness. Exemplary single-site materials are available from H. B. Fuller Company, Vadnais Heights, Minn.

In another embodiment, the material layer 34 may include a precursor web comprising a planar nonwoven substrate having a distribution of attenuated meltable thermoplastic fibers such as polypropylene fibers thereon. The precursor web may be heated to cause the thermoplastic fibers to shrink and form nodulated fiber remnants that impart an abrasive character to the resultant web material. The nodulated fiber remnants may comprise between about 10% and about 50% by weight of the total fiber content of the web and may have an average particle size of about 100 micrometers or greater. In addition to the fibers that are used to form nodulated remnants, the precursor web may contain cellulosic fibers and synthetic fibers having at least one component with a higher melting point than polypropylene to provide strength. The precursor web may be wet laid, air laid, or made by other methods. In one embodiment, the precursor web is substantially free of papermaking fibers. For example, the precursor web may be a fibrous nylon web containing polypropylene fibers (e.g., a bonded carded web comprising both nylon fibers and polypropylene fibers).

The material used to form the material layer 34 may also contain various additives as desired. For example, various stabilizers may be added to a polymer, such as light stabilizers, heat stabilizers, processing aides, and additives that increase the thermal aging stability of the polymer. Further, auxiliary wetting agents, such as hexanol, antistatic agents such as a potassium alkyl phosphate, and alcohol repellants such as various fluoropolymers (e.g., DuPont Repellent 9356H) may also be present. Desired additives may be included in the abrasive layer either through inclusion of the additive to a polymer in the die or alternatively through addition to the abrasive layer after formation, such as through a spraying process.

As described, a second material 38 may be incorporated with the pad 32 for its desired cleaning functionalities. This material 38 may be any conventional nonwoven "soft" web capable of buffing or polishing a surface. Alternatively, the web may be made of a coarse material such that the second material 38 is more coarse or abrasive than the first material 34. For example, the material 38 may be any of the abrasive nonwoven webs described above, or an abrasive foam material. In this instance, the cleaning tool 10 may be used so that the second material 38 is capable of scrubbing coarse surfaces that would otherwise damage the first material 34, particularly a foam material. In fact, the second material 34 may be a web that is more capable of removing dried food substances or ground in dirt and some other unwanted elements from a surface to be cleaned in other exemplary embodiments. The web 34 may comprise abrasive grit or meltblown shot joined to a fibrous substrate.

It should be understood that the present invention includes various modifications that can be made to the embodiments of the cleaning tool 10 as described herein as come within the scope of the appended claims and their equivalents.

What is claimed is:

1. A cleaning tool for use in cleaning a surface, comprising:

a cleaning head having an application face with a plurality of projections extending therefrom;

a pad removably attached to said cleaning head application face by engagement with said projections, said pad formed of a first compressible material that frictionally engages with said projections and having a thickness such that said projections penetrate through said pad and extend beyond an outer planar surface of said first material;

wherein said projections provide an abrasive scrubbing functionality in addition to a cleaning functionality of said pad;

said projections defined in a plurality of discrete regions on said application face, wherein said projections in a first discrete region differ from said projections in a second discrete region in at least one of the characteristics of (a) height relative to said application face, (b) number projections per surface area, (c) hardness, or (d) resiliency such that said different discrete regions provide different cleaning functionalities; and said pad further comprising a second material disposed over at least a portion of said first material, said second material selected to provide said cleaning tool with a desired cleaning functionality different than that of said first material.

2. The cleaning tool as in claim 1, wherein said projections comprise a head and a base portion, with said head portion having a width not greater than said base portion.

3. The cleaning tool as in claim 2, wherein said projections comprise one of a cylindrical or a conical configuration extending from said face.

4. The cleaning tool as in claim 2, wherein said projections are formed integral with said cleaning head.

5. The cleaning tool as in claim 1, wherein said pad comprises an open porous material that frictionally engages with said projections.

6. The cleaning tool as in claim 5, wherein said pad comprises an open cell foam material.

7. The cleaning tool as in claim 1, wherein said second material comprises a nonwoven web, said projections extending beyond an outer planar surface of said nonwoven web.

8. The cleaning tool as in claim 1, wherein said second material comprises a nonwoven web, said projections extending into but not beyond an outer planar surface of said nonwoven web.

9. The cleaning tool as in claim 1, further comprising an agent contained within a pouch disposed within a recess defined in said pad, said agent being released upon engagement of said pad by said projections in one of said discrete regions of projections underlying said pouch having projections with a height relative to said application face that is less than that of projections in a different discrete region adjacent to said pouch.

10. The cleaning tool as in claim 9, wherein said recess is defined in said first material, said second material being pervious to said agent released from said pouch and providing said cleaning tool with a desired cleaning functionality different than that of said first material.

11. The cleaning tool as in claim 1, further comprising an agent stored directly within a recess defined in said pad, said recess covered by a film member that is pierced by said projections in one of said discrete regions of projections extending into said recess to release said agent.

12. The cleaning tool as in claim 11, wherein said recess is defined in said first material.

13. The cleaning tool as in claim 1, wherein said tool is configured as a mop, said cleaning head configured as a mop head, and said pad comprising a disposable component attachable to said mop head.

14. The cleaning tool as in claim 1, wherein said projections have an axis at an acute angle to the cleaning head.

15. The cleaning tool as in claim 1, wherein said projections comprise a curved section.

16. The cleaning tool as in claim 15, wherein said curved section defines a hook.

17. A mop for use in cleaning a surface, said mop comprising:

a mop head, and a handle attached to said mop head;

said mop head defining an application face comprising a plurality of projections extending transversely therefrom from a base portion to a head portion;

a disposable pad removably attached to said application face by engagement of said pad with said projections, said pad comprising a first material having a thickness and composition such that said projections penetrate through said pad and extend beyond an outer planar surface of said first material;

wherein said projections provide an abrasive scrubbing functionality in addition to a cleaning functionality of said pad;

said projections defined in a plurality of discrete regions on said application face, said projections in a first said discrete region differing from said projections in a second said discrete region in at least one of the characteristics of (a) height relative to said application face, (b) number of projections per surface area, (c) hardness, or (d) resiliency such that said discrete regions provide different cleaning functionalities; and further comprising a cleaning agent stored within a recess defined in said pad.

18. The mop as in claim 17, wherein said projections extend generally linearly from said base portion to said head portion.

19. The mop as in claim 18, wherein said projections comprise one of a cylindrical or a conical configuration.

20. The mop as in claim 17, wherein said first material comprises a compressible material that frictionally engages with said projections, and said pad comprises a second nonwoven web material disposed over at least a portion of said first material, said projections extending at least into said nonwoven web material and, with compression of said nonwoven web material in use of said mop, said projections extendable beyond an outer planar surface of said nonwoven web material.

21. The mop as in claim 17, wherein said cleaning agent is contained within a pouch disposed within said recess defined in said pad, said cleaning agent being released upon use of said mop by penetration of said pouch by projections in one of said discrete regions of projections that underlies said pouch having a height relative to said application face that is less than that of projections in a different discrete region adjacent to said pouch.

22. The mop as in claim 21, wherein said first material comprises a compressible material that frictionally engages with said projections, said recess defined in said first material, and further comprising a second material disposed over at least a portion of said first material and said recess, said second material being pervious to said agent released from said pouch and providing said cleaning tool with a desired cleaning functionality different than that of said first material.

23. The mop as in claim 17, wherein said recess is covered by a film member that is pierced by said projections in one of said discrete regions of projections that extend into said recess to release said cleaning agent.

24. The mop as in claim 23, wherein said first material comprises a compressible material that frictionally engages with said projections, said recess defined in said first material.

25. The mop as in claim 17, wherein said first material of said pad comprises an open cell structure that frictionally engages with said projections.

26. The mop as in claim 25, wherein said first material comprises a foam material.

* * * * *